US006925762B2

(12) United States Patent
Halford

(10) Patent No.: US 6,925,762 B2
(45) Date of Patent: Aug. 9, 2005

(54) ARCH STRUCTURE

(75) Inventor: Edward Halford, Comberton (GB)

(73) Assignee: Peter Dann Limited (GB)

( * ) Notice: Subject to any disclaimer, the term of this patent is extended or adjusted under 35 U.S.C. 154(b) by 0 days.

(21) Appl. No.: 10/203,395

(22) PCT Filed: Feb. 9, 2001

(86) PCT No.: PCT/GB01/00539

§ 371 (c)(1),
(2), (4) Date: Nov. 29, 2002

(87) PCT Pub. No.: WO01/59224

PCT Pub. Date: Aug. 16, 2001

(65) Prior Publication Data

US 2003/0177716 A1 Sep. 25, 2003

(30) Foreign Application Priority Data

Feb. 10, 2000 (GB) ..... 0003085

(51) Int. Cl.[7] ..... E04B 1/32

(52) U.S. Cl. ..... 52/86; 52/81.2; 52/63; 52/646; 52/653.2; 52/655.1

(58) Field of Search ..... 52/86, 80.2, 81.1, 52/81.2, 81.3, 63, 645, 646, 653.1, 653.2, 655.1, 148, 23

(56) References Cited

U.S. PATENT DOCUMENTS

| | | | | | |
|---|---|---|---|---|---|
| 2,693,195 | A | * | 11/1954 | Frieder | 135/122 |
| 3,857,213 | A | * | 12/1974 | Miyake | 52/86 |
| 4,118,904 | A | * | 10/1978 | Sprung | 52/63 |
| 4,223,506 | A | * | 9/1980 | Blair et al. | 52/644 |
| 4,347,690 | A | * | 9/1982 | Wallace, Jr. | 52/93.1 |
| 4,583,331 | A | | 4/1986 | Hunt et al. | |
| 4,593,710 | A | * | 6/1986 | Stafford et al. | 135/136 |
| 4,676,032 | A | * | 6/1987 | Jutras | 52/2.17 |
| 5,243,803 | A | * | 9/1993 | Tabata et al. | 52/646 |
| 6,055,999 | A | * | 5/2000 | Grey | 135/147 |

FOREIGN PATENT DOCUMENTS

| | | |
|---|---|---|
| FR | 2 262 167 A | 9/1975 |
| FR | 2 696 487 A | 4/1994 |

* cited by examiner

*Primary Examiner*—Brian E. Glessner
(74) *Attorney, Agent, or Firm*—Brinks Hofer Gilson & Lione; G. Peter Nichols

(57) ABSTRACT

An arch structure (12) comprising several struts (14) interconnected by five joints (15) to form an arch (16), and two series of cables (17, 18). The two ends of the arch (16) rest on ball joints which are fixed to the ground.

27 Claims, 6 Drawing Sheets

ARCH STRUCTURE

This application claims priority to PCT Application Ser. No. PCT/GB01/00539 filed Feb. 9, 2001 and published in English on Aug. 16, 2001, as PCT WO 01/59224, the entire contents of which is incorporated herein by reference, and to GB Application No. 0003085.8 filed Feb. 10, 2000.

The present invention relates to an arch structure, in-particular, a tension structure which consists of an articulated arch or arches restrained by cables, which may be covered to form a building or tent or for other purposes where it is desired to support objects above an unobstructed area. In addition, the invention is concerned with a method of erecting such a structure which does not require large cranes or other heavy equipment, and methods of rendering the structure resilient to accidental damage. The invention is also concerned with a covering system for a structure.

BACKGROUND

Tension structures are now well established as a way of covering large areas economically and many examples exist, perhaps the best known in Great Britain being the Millennium Dome. These structures normally have a fabric membrane stretched tightly between supporting members to form a roof. In smaller structures these supports are masts or steel arches but in larger structures, such as the Dome, the fabric may be stretched between cables which themselves are tensioned between the main supports. This is necessary because there is a practical limit to the size of fabric panel which may be used. Large tension structures are thus composed of main supports, a network of cables and the tensioned fabric.

SUMMARY

All existing tension structures employ main supports of conventional design which are generally erected in advance of the cable network and which are structurally independent of it. Usually they are of massive proportions such as in the case of the masts of the Millennium Dome and they are correspondingly difficult to transport and erect. These considerations tend to restrict the maximum size of structure which is practicable. The Millennium Dome approaches the size limit which is attainable by conventional means.

In known structures therefore, there are restrictions on the uninterrupted area that can be spanned, by the need to provide internal supports. It is an object of the present invention to provide a structure which does not require internal supports but which can cover greater areas than previously possible.

It is a further object of the invention to provide such a structure that uses a minimum of material.

It is a further object of the invention to provide a method of erecting the structure which does not require the use of large cranes.

It is a still further object of the invention to provide a covering system suitable for use in conjunction with such a structure.

According to one aspect of the invention, there is provided an arch structure comprising a plurality of relatively rigid struts, a plurality of joints, a plurality of cables and at least two nodes, in which the struts are joined together to form an arch by means of the joints, the cables in a first series are each connected at one end to a joint and at their other end to a first node on one side of the arch, and the cables in a second series are each connected at one end to a joint and at their other end to a second node on the other side of the arch. The joints may be rigid joints, or moveable joints. In the latter case, they may be ball joints, universal joints or hinges such as simple pinned hinges. The moveable joints allow the struts a degree of relative angular freedom.

Thus, the cables triangulate the system. This arrangement enables the structure to be formulated to satisfy the criteria which are necessary to make it a theoretically efficient structure (minimum theoretically possible weight). These include the need to have every element fully stressed throughout at some point within the loading envelope (the regime of load cases to which it will be subjected at some stage of its life), to have no elements which require secondary structure to afford them stability and to minimize the weights of the compression elements by restricting their lengths. The structure can therefore satisfy the requirements of Maxwell's and Mitchell's theorems of structural efficiency. The resulting structures can be lighter than any alternatives and are capable of much larger unobstructed spans.

The arrangement of the cables is crucial to the stability of the structure. Preferably, they will radiate from centrally located nodes, one cable to each joint in the arch. The arch will thus be restrained from two node points, one on each side of the arch.

The struts are preferably circular section tubes made from plastics material or a metal such as aluminum, aluminum alloy or steel, preferably stainless steel. The lengths of these members is a function of the geometry of the structure of which they are a part and their sizes will be determined by calculation to suit the forces which will occur in this structure. For example, a small structure with a span of 7.5 m, a length of 9.5 m and a height of 3 m designed to support a total load of 10 kN would require aluminum alloy tubes of 1.7 m length 30 mm outside diameter and 1 mm wall thickness. The joints are preferably moveable joints. In the case of ball or universal joints, they will allow limited relative angular movement between adjacent struts in any plane. In the case of a pinned hinge, this will allow relative movement only in a plane normal to the axis of the pin. However, the pinned hinges may be attached to one or both of their respective struts with freedom for the connection between the hinge and the struts to rotate about the axis of the struts. This arrangement works even if one side of the hinge is rigidly connected to one of the two struts which it connects. The cost of this arrangement is less than fabricating a proper ball joint but has an equivalent effect. Connection to the cable may be effected by angled straps which also rotate on the hinge pin.

The cables are preferably of a strong, stiff light-weight material, preferably a polyamide, more preferably a long chain polyparaphenylene terephthalamide, such as Kevlar (Reg. T.M.) or high tensile steel. The nodes and the ends of the arch may be attached to the ground, though either or both could be anchored above ground level.

The strength and stiffness properties of these structural elements and the pre-tensions which are applied to the cables determine the strength and stability of the structure. Their values in any particular case may be determined by a suitable method of structural analysis such as dynamic relaxation.

The simplest form of the structure is a single arch with one set of cables each side radiating from one node each side, each node being fixed to the ground. The arch may consist of three or more straight struts but usually the number of struts would be between six and twelve. In general all the struts would be of equal length, but not necessarily. The joints in the arch would normally lie on a circular arc but other shapes are also possible, including asymmetrical shapes.

The invention extends to a combination of two or more arches and adjacent arches could share an intermediate node point. Any number of arches may be used giving the possibility of an infinite variety of completed structural forms provided that the basic requirements of triangulation are met. When the arch is restrained to a ground fixing as opposed to a node above the ground, triangulation may be achieved by attaching the cables to more than one node on the ground. Examples of the variations include: two opposite, parallel, arches; four similar arches with their feet at the corners of a square sharing a common central node; a long line of arches forming a tunnel-like structure; a polygonal arrangement of arches sharing a common central node; combinations of arches of different sizes in lines or polygons.

The arches may lie in a flat vertical plane or in an inclined plane or they may not lie in a flat plane at all provided that the arrangement, when triangulated with the cables, meets the criteria for structural efficiency.

A consequence of structural efficiency is that every member is essential to the stability of the structure. If a member is removed or broken for any reason, collapse of the structure could ensue. Various methods of providing resilience and resistance to such an event are contemplated. Firstly, protection could be added in vulnerable areas, for example, the cables could be encased in steel tubes near to ground level. Secondly, a dual system of cables running to separate sets of nodes could be provided, then each system would be capable of resisting at least half the total load. Thirdly, some of the erection system cables (described below) could be used to provide a degree of redundancy in the finished structure. An alternative method of reducing vulnerability to accidental damage is by combining three or more arches in configurations which permit the collapse of one arch without causing collapse of the others.

The structures are capable of very large spans indeed (more than a kilometre) but such large structures could not be erected by conventional methods because suitable equipment, such as cranes are not available. A means of erection requiring only a ground level winch and temporary erection mast has been devised, and forms part of the invention.

The invention therefore also extends to an erection system which comprises a lacing system of temporary cables, a temporary erection mast and a winch and preferably, a hawser. Preferably, the mast is pivoted on the ground midway between the arch feet. One cable node is preferably attached to the top of the mast whilst it is near the ground. The mast height is chosen so that when the mast is pulled up by the winch, the node will eventually arrive at its final, correct, erected position where it may be secured permanently. The mast and erection lacing may then be removed.

If the mast is correctly positioned lying on the ground with its feet on the foundation pivots, the forces in the structure during the erection are theoretically in balance. However, particularly when moveable joints are used, it is in a state of unstable equilibrium and will not remain in the correct shape without assistance. This may be provided by three sets of very light cables or by other means such as by temporarily locking the joints. When the structure is in its correct shape, there is no theoretical force in these cables.

Preferably, the temporary erection lacing consists of radial cables from the foot of the erection mast to the joints between the arch struts, crossed diagonal cables running from the arch joints to points on the adjacent permanent cables on the side of the erection mast a small distance from the arch joints, cables connecting alternate arch joints, and very light struts stiffening the ends of the permanent cables lying within the crossed bracing.

Preferably, the cables are made from an ordinary rope material chosen for economy and stiffness, e.g. a polypropylene rope.

Thus, the present invention seeks to overcome the various difficulties in two ways. Firstly, the sizes of the members are minimized by using a "theoretically efficient" structural arrangement and secondly, by utilizing one of the properties of this arrangement, the structure is made easily erectable using winches on the ground and without the need for temporary support or cranes.

The main supports and the cable network are interdependent, neither able to exist without the other. This enables the main supports to be very much smaller than would be possible with conventional structures. For example, the twelve masts of the Millennium Dome are each around twice as high as the dome itself, whereas the individual struts forming the arches of an equivalent structure designed in accordance with the principles of this invention would only be perhaps half of its height. The strength of a slender strut is related inversely to the square of its length which is part of the reason why this new type of structure is much more efficient than conventional structures.

Structures having an appearance similar to this invention may have been built and/or proposed. The term "restrainer arch" has been uses. However none so far has met the essential criteria of this invention which are that essentially, only axial forces will be applied to the main members and that the geometrical arrangement of the structure will render it self restraining.

According to a further aspect of the invention, there is provided a covering system for a main structure, the system comprising a membrane, a series of membrane support ribs, a series of rib tensioning cables, one associated with each rib, means for tensioning each cable, and a plurality of rib support members associated with each rib and respective tensioning cable, each tensioning cable being connected to the ends of its respective rib thereby imparting a buckling force on the rib, the rib support members being arranged to inter-connect with the respective rib and tensioning cable in a spaced relationship to form a support rib substructure, the system also including means for connecting the support rib substructures to the main structure.

Preferably, the support members are arranged to be attached to the main structure, particularly to main support cables of the main structure. Preferably the membrane is attached to the ribs. Preferably the ribs are I-sectioned.

The support ribs act in a manner similar to the radial ribs of an umbrella. The covering membrane may be attached to them by sliding in a luffing groove or by hooks, rings or other suitable means. Each rib will be made from a suitably stiff and strong elastic material such as an aluminum extrusion, a pressed metal section or reinforced plastics moulding. Preferably the ribs are supported by the cables or arches of the main structure where they pass above them. Each rib is subjected to an axial compression force by means of the tensioning cable which preferably runs directly beneath it. This cable preferably also passes above the supporting structure.

Each support member or "chair" preferably rests on the supporting structure at each support point and holds the rib and the tensioning cable in the correct location. The ends of the ribs may be held in position by an edge cable. This may also serve as part of the tensioning mechanism and may be anchored to the ground. The tensioning mechanism may consist of reeving through pulley blocks such that the end of the cable is made to pull against the end of its rib. This may either be secured by cleating or by some other method at the end of the rib or cable or by attachment to the edge cable. The latter method will normally be preferable in order to provide a means of introducing sufficient tension into the edge cable.

The compression in the rib coupled with its curvature allows it to act as an arch. It is restrained against sideways buckling by the covering membrane. It is restrained against upward buckling by its connection to the tensioning cable and it is restrained against downward buckling by its upward curvature. It therefore behaves very much as the rib of an umbrella and is similarly slender and rigid in relation to its span. The support chairs provide sufficient sideways restraint to the rib to hold it in position before the membrane is attached.

The covering membrane itself may be of a conventional roofing material such as profiled metal sheeting or more usually it will be a fabric or inflated ETFE foil cushion. If it is a fabric it may be tensioned transversely by pulling it into "V" shaped troughs with central tensioning cables. If it is ETFE foil cushions it will be tensioned by inflating the cushions.

The support chairs, the rib tensioning cables and possibly the ribs themselves may be attached to the main structural cables of the main structure before the main structure is erected to facilitate easy erection. If the fabric is secured to the ribs in luffing grooves it may be pulled up the structure with halyards within the grooves. This might be carried out from ground level on the opposite side of the structure and thereby avoid the need for high level working.

This covering system may be suspended beneath the support structure by suitably modifying the support chairs.

The covering system may be made to provide insulation by using two or more separate covering membranes with air spaces between. If ETFE cushions are used the insulation which they provide may be maintained at their edges by incorporating an insulating layer within the rib depth and by securing the cushion edges in two luffing grooves one above the other.

Thus, the invention may provide a ribbed support with a covering membrane suitable for the structure described or other similar structures and may offer the following advantages over existing systems. A weather proof membrane may be supported well above the main structure. This will leave the main structure protected from the weather and available for support of equipment within the covered area. The covering can follow a smooth curve around the structure. The ribs are easily erected. The force on any edge tensioning cables will be much smaller than occurs with conventional covering methods such as that used at the Millennium Dome.

BRIEF DESCRIPTION OF THE DRAWINGS

The invention may be carried into practice in various ways, and some embodiments will now be described by way of example, with reference to the accompanying drawings, in which:—

DETAILED DESCRIPTION

Figure 1:
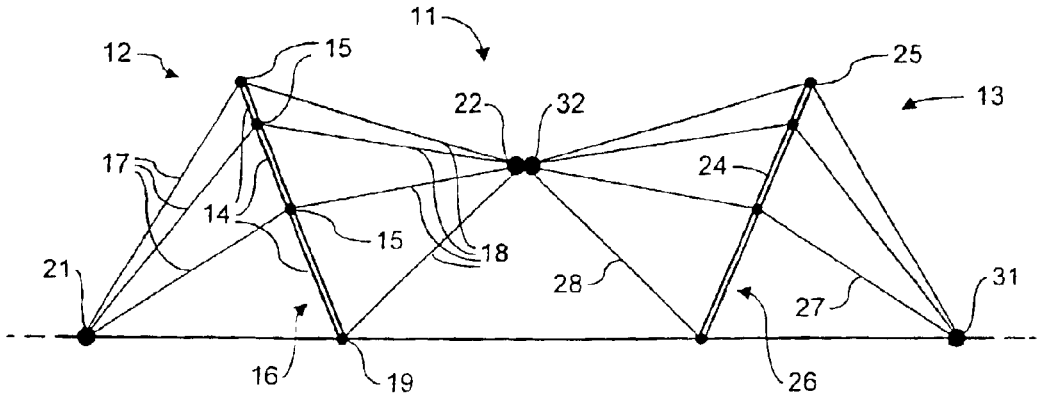
FIGS. 1 to 4 are respectively a side elevation, a plan view, a front elevation and a perspective view of a structure in accordance with the invention comprising two arches.
Figure 2:
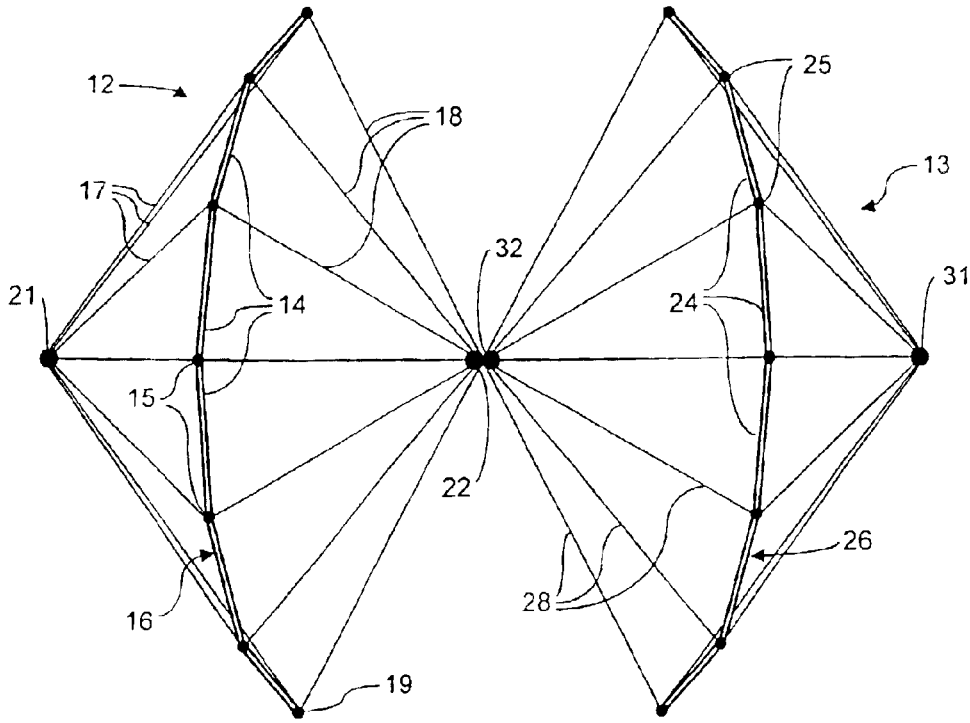
Figure 3:
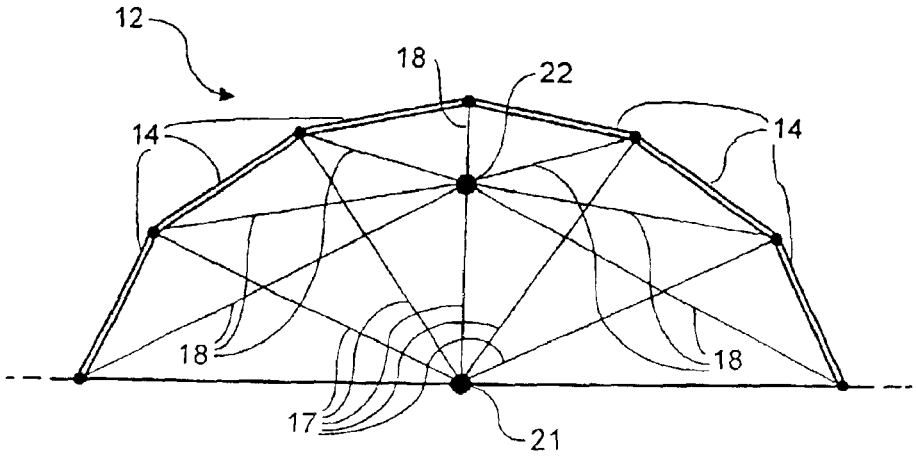
Figure 4:
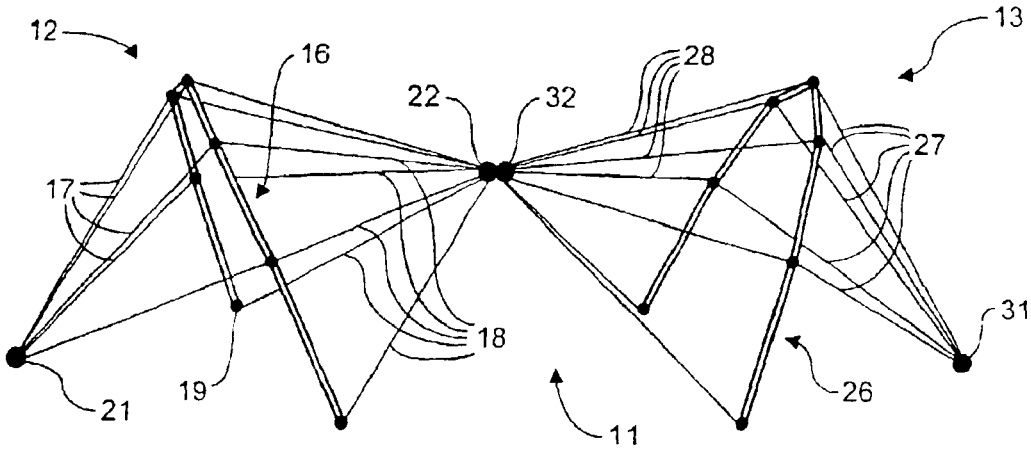

The overall structure 11 shown in FIGS. 1 to 4 comprises two similar arch structures 12 and 13. The arch structure 12 comprises six struts 14 interconnected by five ball joints 15 to form an arch 16, and two series of cables 17, 18. The two ends of the arch 16 rest on ball joints (not shown) which are fixed to the ground by mean of foundations 19.

One series of cables consists of seven individual cables 17, two of which have one end respectively attached to the foundations 19 and the other five of which have one end attached respectively to one of the five ball joints 15. The other ends of each of the seven cables 17 are attached together at a node 21 and the node 21 is anchored to the ground on one side of the arch 16.

The second series of cables 18 are similarly attached with a node 22 on the other side of the arch 16, but in this case, the node 22 is not anchored to the ground.

The second arch structure 13 is a mirror image of the first arch structure 12 with struts 24 and ball joints 25 forming an arch 26 and two series of cables 27, 28. A first node 31 is anchored to the ground while the second node 32 is connected to the corresponding node 22 of the first arch structure 12, above ground level.

The struts 16, 26 are tubes of circular section aluminum alloy and the cables 17, 18, 27 and 28 are of Kevlar (Reg. T.M.). The foundations 19 are conventional structural engineering ground foundations, and the nodes 21, 31 are conventional ground anchors. The nodes 22, 32 may be of any convenient design, provided that they serve as an attachment point for their respective cables 18, 28 and are capable of being rigidly and reliably connected together. One example is shown in more detail in FIG. 9.

Figure 5A:
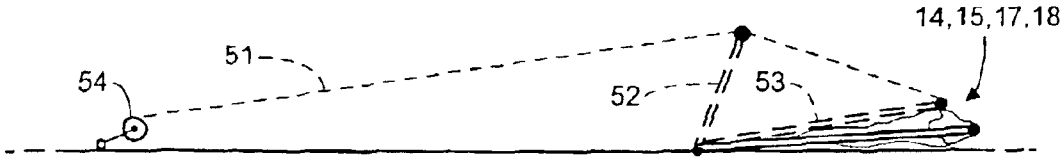
FIGS. 5*a,* 5*b* and 5*c* are side views of successive stages in the erection of an arch in accordance with the invention.
Figure 5B:
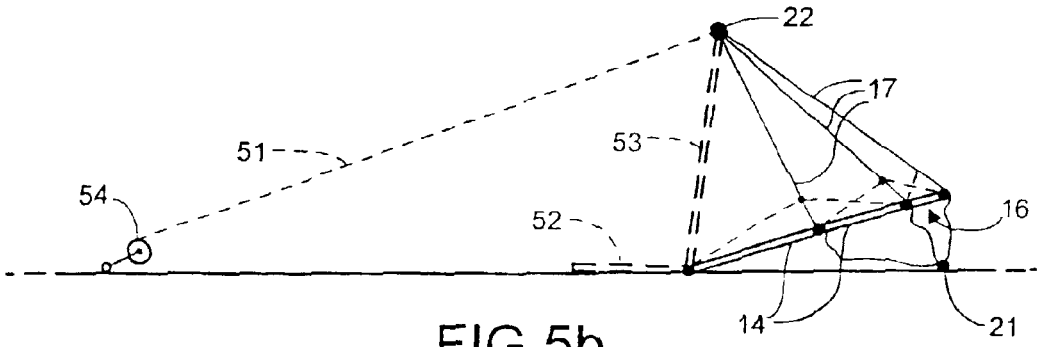
Figure 5C:
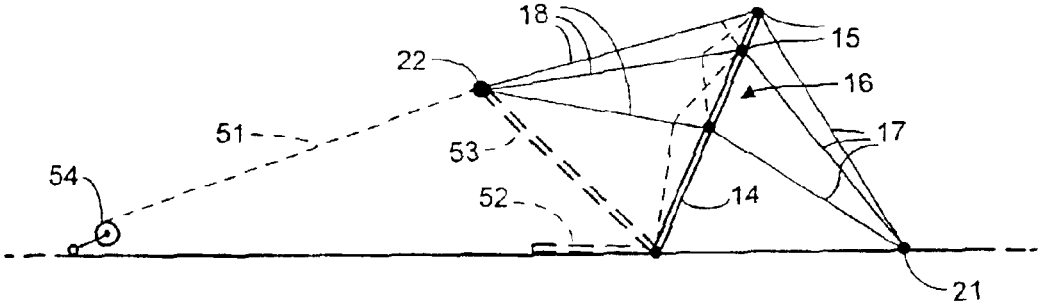
Figure 6:
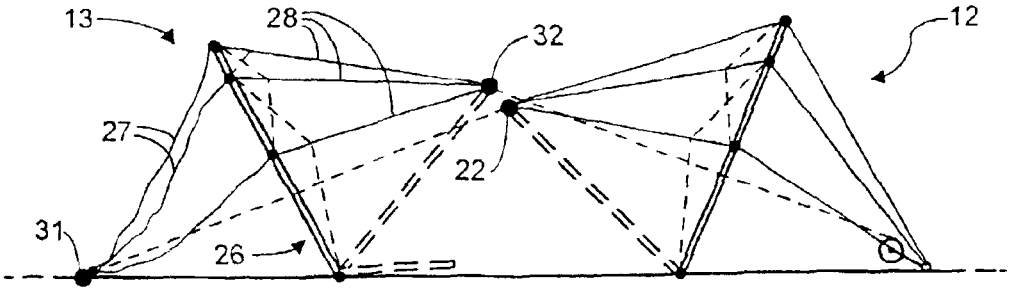
FIG. 6 is a side view of two arches at the stage shown in FIG. 5*c,* prior to being mutually connected to form the structure of FIG. 1.
Figure 7:
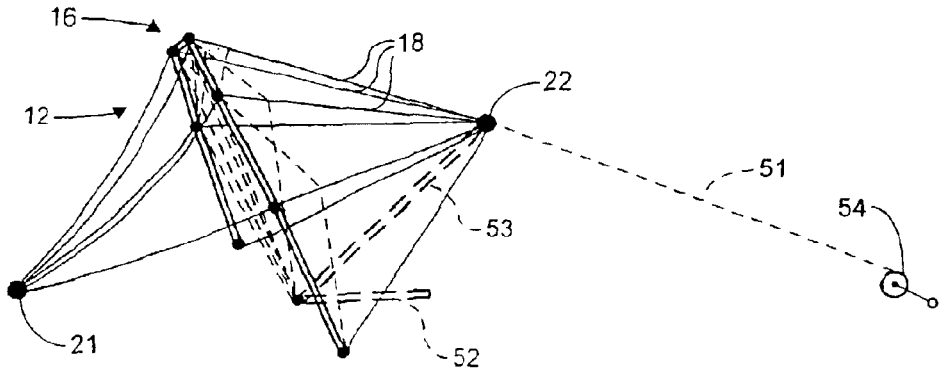
FIG. 7 is a perspective view corresponding to FIG. 5*c;*
Figure 8:
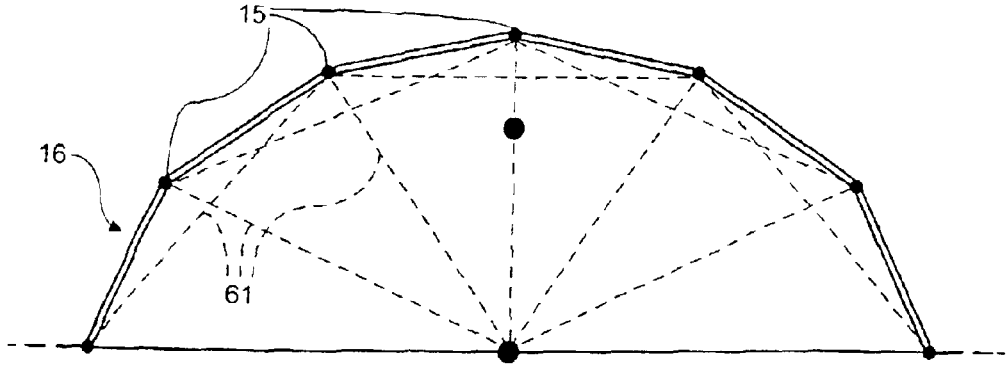
FIG. 8 shows the pattern of bracing in the plane of the arch, during erection.

The erection of an arch structure 12 (shown from the opposite side to that in FIGS. 1 and 4) is shown in FIGS. 5 to 7.

Firstly, the struts 14, ball joints 15, cables 17, 18 and nodes 21, 21 are interconnected as described above and laid out on the ground, with the arch 16 formed approximately to shape. The node 21 is firmly anchored to the ground. A hawser 51 is attached to the node 22, extending over a brace 52 which is pivotally connected to the ground. A temporary mast 53 has its base pivotally connected to the same point on the ground and its top connected to the node 22.

The hawser 51 is then hauled in by means of a winch 54. The structure progresses from the position shown in FIG. 5*a,* with the mast 53 pivoting upwards through the position shown in FIG. 5*b* to the position shown in FIG. 5*c*. Here, the arch 16 is in its final orientation and all the cables 17, 18 are tensioned.

The operation is then repeated with a second arch structure 13, as shown in FIG. 6. The respective nodes 22, 32 are connected together so that the two arch structures 12, 13 are maintained in tension. The winches 54, hawsers 51, braces 52 and masts 52 are then disconnected and removed.

In order to ensure that the arch structures 12, 13 adopt the correct shape as they are being erected, three series of temporary, light, supporting cables 61 are deployed as shown in FIGS. 5, 6, 7 and 8. The first series connects alternate ball joints 15 or 19. A second series connects the foot of the temporary erection mast 53 to ball joints 15. A third series connects ball joints 15 and 19 to point on the adjacent main cables 18 as shown in FIGS. 5, 6, and 7. Cables are stiffened between these connection points and their ends at ball joints 15 by light stiffening struts.

Figure 9:
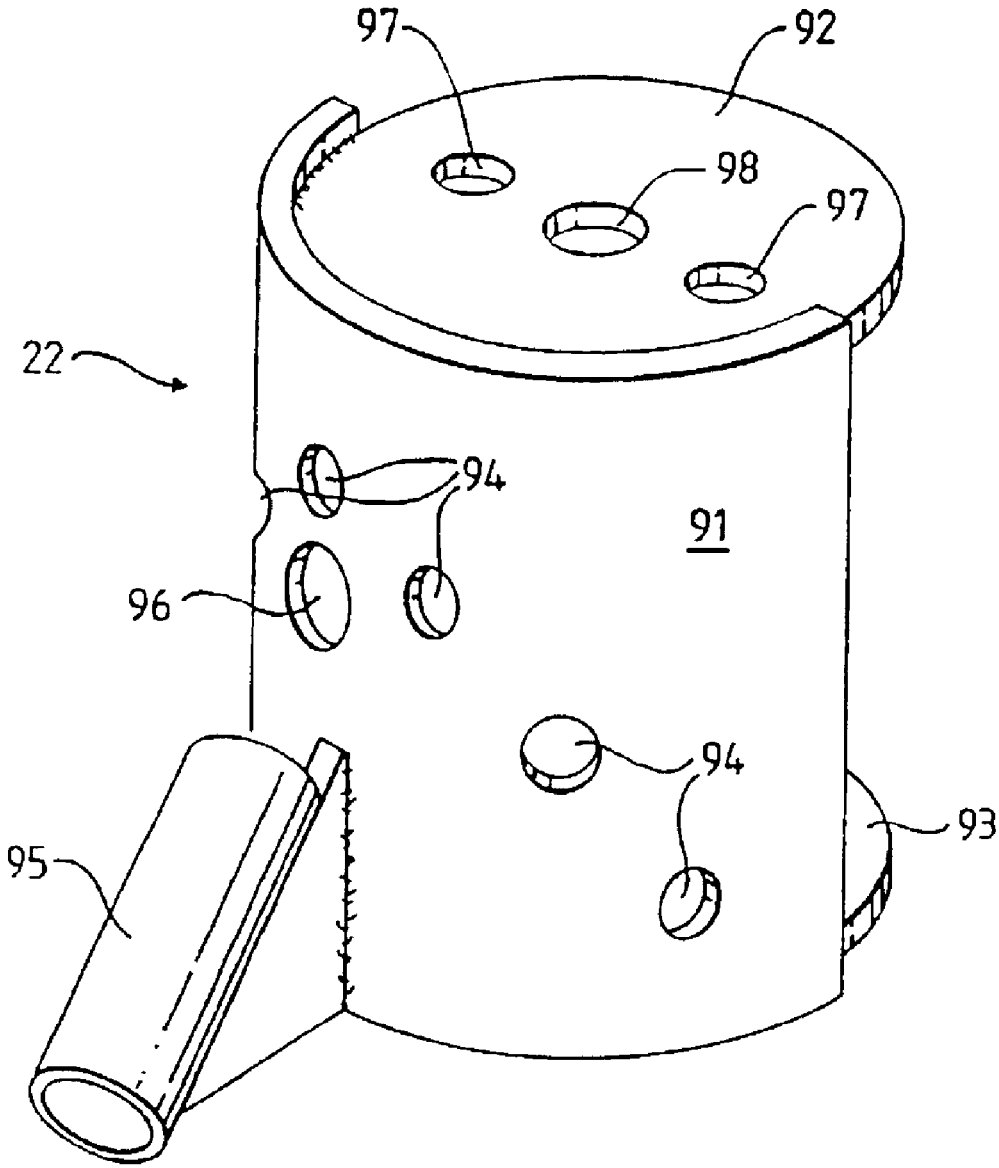
FIG. 9 is a perspective sketch of an example of a suitable node.

FIG. 9 shows one possible suitable design of node 22. The node 22 comprises a semi-cylindrical body 91, to which are welded a circular upper plate 92 and a circular lower plate 93. The body 91 has a series of holes 94 arranged on an arc and a tube 95 attached to its outside surface so that its axis extends at 45° to the axis of the body 91. The body 91 also has a further hole 96 in line with the tube 95. The upper plate 92 has a pair of holes 97 and a central hole 98 in line with the tube 95 and the hole 96 in the body 91. The lower plate 93 also has two holes (not shown) generally equivalent to the holes 97 in the upper plate 92.

In use, the cables 18 are connected to the body 91 by means of the holes 94. The tube 95 and holes 96, 98 are used for the attachment of the hawser 51 during erection. The tube 95 is used for attaching the temporary erection mast 53 to the node 22. The hole 98 is provided for the attachment of ancillary items such as lights to the finished structure. The hole 96 is provided as a guide for the hawser of the second arch 13 so that the second node 32 is guided towards the first node 22 as it is being erected. (FIG. 6 does not show this feature in use).

The node 32 is similar to the node 22 except that its upper and lower plates are offset from the respective positions of the upper and lower plates 92, 93. Thus, when they are brought together, the respective upper and lower plates in the two nodes 22, 32 lie in a stacked relationship with each other. When the two arch structures 12, 13 are therefore fully erected in position, the two nodes 22, 32 fit together to form a complete cylinder with the respective upper and lower plates 92, 93 overlying each other. In this position, the holes e.g. 97 in the plates 92, 93 lie in registry and so the nodes 22, 33 are connected together by means of bolts (not shown) located in the holes e.g. 97.

Figure 10:
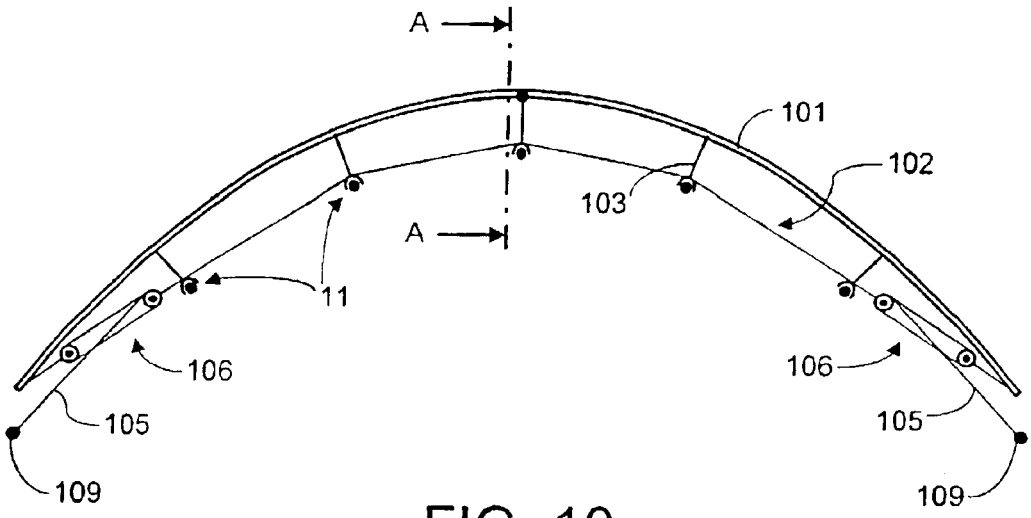
FIG. 10 is a side view of a covering system in accordance with the invention.
Figure 11:
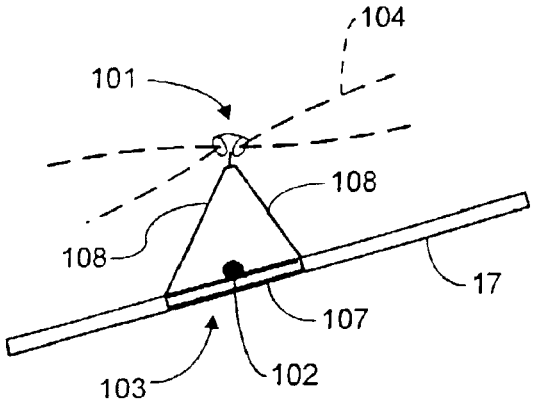
FIG. 11 is a section on the line AA in FIG. 10.

FIGS. 10 and 11 show a covering system. The system is shown in position on a structure as described above; for reasons of clarity, only the cables 17 of the structure 11 are shown.

The system comprises a rib 101, a tensioning cable 102, a series of five support chairs 103, and a covering membrane 104. The rib 101 is an I-section aluminum extrusion with a longitudinal luffing channel on each side (not shown). The cable 102 is made from steel, Kevlar or other suitable rope. At each end of the cable 102, there is tensioning rope 105 which acts on the respective end of the cable 102 through a pulley system 106 in order to connect each end of the cable 102 to the rib 101 and tension the cable 102. This in turn exerts a buckling force on the rib 101.

Each support chair 103 comprises a saddle 107 which is attached to a main cable 17 and two wires 108. The tensioning cable 102 passes through an eye (not shown) fixed to the saddle 107 and the wires are attached to the rib 101. It will be understood that the chairs 103 serve to maintain the tension in the tensioning cable 102 and define its shape.

The membrane 104 is in the form of inflatable ETFE cushions. These have a peripheral bead (not shown) which is located in the luffing grooves of the rib 101. It will also be understood that in practice, there will be several rib/cable/chair sub-assemblies. Thus, the membrane 104 sections will form a continuous covering.

The ends of the tensioning cables 102 (or the ropes 105) are joined to an edge tensioning cable 109, which is anchored to the ground at various points.

What is claimed is:

1. An arch structure comprising a plurality of relatively rigid struts, a plurality of joints, a plurality of cables and at least two nodes, in which struts are joined together to form an arch by means of the joints, the cables in a first series are each respectively connected at one end to one of the joints and at their other end to a first node on one side of the arch, and the cables in a second series are each respectively connected at one end to one of the same joints and at their other end to a second node at the other side of the arch, wherein adjacent arches share an intermediate node point and whereby each of the struts and associated cables form a triangulated arrangement when the arch structure is erected and substantially only axial forces exist in the struts.

2. A structure according to claim 1, wherein the struts are circular section tubes made from a material selected from the group consisting of plastics, aluminum, aluminum alloy and steel.

3. A structure according to claim 1 in which the joints are moveable joints.

4. A structure according to claim 1 wherein the joints are selected from the group consisting of ball joints, universal joints and hinges.

5. A structure according to claim 4, wherein the joints are pinned hinges attached to at least one of their respective struts with freedom for the connection between the hinge and the struts to rotate about the axis of the struts.

6. A structure according to claim 1 wherein the cables are a strong, stiff, light-weight material.

7. A structure according to claim 6 wherein the cables are made from a polyamide.

8. A structure according to claim 1 wherein the nodes and at least one end of the arch is attached to a ground surface in use.

9. A structure according to claim 1 wherein all the struts are of equal length.

10. A structure according to claim 1 wherein the joints in the arch lie on a circular arc.

11. A structure according to claim 1 wherein the arch is made up from between 6 and 12 struts.

12. A structure according to claim 1 wherein the cables are encased in steel tubes near ground level.

13. An erection system for an arch structure that includes a plurality of relatively rigid struts, a plurality of joints, a plurality of cables and at least two nodes, in which struts are joined together to form an arch by means of the joints, the cables in a first series are each respectively connected at one end to one of the joints and at their other end to a first node on one side of the arch, and the cables in a second series are each respectively connected at one end to one of the same joints and at their other end to a second node at the other side of the arch, whereby each of the struts and associated cables form a triangulated arrangement when the arch structure is erected and substantially only axial forces exist in the struts, the erection system comprising a lacing system of temporary cables, a temporary erection mast and a winch; the mast having a foot being pivoted on a ground surface in use between at least two feet of the arch, one cable node being attached to a top of the mast, and a height of the mast being selected so that when the mast is pulled up by the winch, the node will eventually arrive at its intended erected position.

14. An erection system according to claim 13 wherein the lacing consists of radial cables from the foot of the erection mast to the joints between the struts, crossed diagonal cables running from the arch joints to points on the adjacent permanent cables on the side of the erection mast a small distance from the arch joints, cables connecting alternate arch joints and very light struts stiffening the ends of the permanent cable lying within the crossed bracing.

15. A covering system for an arch structure that includes a plurality of relatively rigid struts, a plurality of joints, a plurality of cables and at least two nodes, in which struts are joined together to form an arch by means of the joints, the cables in a first series are each respectively connected at one end to one of the joints and at their other end to a first node on one side of the arch, and the cables in a second series are each respectively connected at one end to one of the same joints and at their other end to a second node at the other side of the arch, whereby each of the struts and associated cables form a triangulated arrangement when the arch structure is erected and substantially only axial forces exist in the struts, the covering system comprising a membrane, a series of membrane support ribs, a series of rib tensioning cables, one associated with each rib, means for tensioning each rib tensioning cable, and a plurality of rib support members associated with each rib and respective tensioning cable, each tensioning cable being connected to the ends of its respective rib thereby imparting a buckling force on the rib, the rib support members being arranged to interconnect with the respective rib and tensioning cable in a spaced relationship to form a support rib substructure, the system also including means for connecting the support rib substructure to the arch structure.

16. A covering system according to claim 15 wherein the support members are arranged to be attached to the arch structure.

17. A covering system according to claim 15 in which the membrane is attached to the ribs.

18. A covering system according to claim 15 wherein the ribs are I-sectioned.

19. A covering system according to claim 15 wherein the ribs are supported by the cables or arches of the arch structure where they pass above them.

20. A covering system according to claim 15 wherein each support member is in the form of a "chair" which rests on the arch structure at each support point and holds the rib and the tensioning cable in the correct location.

21. A covering system according to claim 15 wherein the ends of the ribs are held in position by an edge cable.

22. A covering system according to claim 15 wherein the tensioning mechanism consists of reeving through pulley blocks such that the end of the cable is made to pull against the end of its rib.

23. A covering system according to claim 15 wherein the covering membrane itself is of a conventional roofing material.

24. A covering system according to claim 23 wherein the covering membrane is of fabric and is tensioned transversely, pulling the fabric into V-shaped troughs with central tensioning cables.

25. A covering system according to claim 23 wherein the covering membrane is in the form of an inflated ETFE foil sack.

26. A covering system according to claim 15 further comprising a plurality of separate covering membranes with air spaces between them.

27. A structure according to claim 1, further comprising additional cables providing a degree of redundancy in the structure.

* * * * *